US009099819B2

(12) United States Patent
Hwang et al.

(10) Patent No.: US 9,099,819 B2
(45) Date of Patent: Aug. 4, 2015

(54) ELECTRICAL CONNECTOR HAVING SHIELDING MEMBERS

(71) Applicant: HON HAI PRECISION INDUSTRY CO., LTD., New Taipei (TW)

(72) Inventors: Tzu-Yao Hwang, New Taipei (TW); Yen-Chih Chang, New Taipei (TW); Ke-Hao Chen, New Taipei (TW); Wei-Hung Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 49 days.

(21) Appl. No.: 14/101,372

(22) Filed: Dec. 10, 2013

(65) Prior Publication Data

US 2014/0162471 A1 Jun. 12, 2014

(51) Int. Cl.

| | |
|---|---|
| ***H01R 12/00*** | (2006.01) |
| ***H01R 13/648*** | (2006.01) |
| ***H01R 12/70*** | (2011.01) |
| ***H01R 13/6586*** | (2011.01) |

(52) U.S. Cl.

CPC ..... *H01R 12/7082* (2013.01); *H01R 13/648* (2013.01); *H01R 13/6586* (2013.01)

(58) Field of Classification Search

USPC ..... 439/65, 66, 68, 69, 70, 71, 74, 80, 82, 439/91, 607.01, 607.05, 607.08, 607.11, 439/607.55, 660, 884, 862, 701, 901

See application file for complete search history.

(56) References Cited

U.S. PATENT DOCUMENTS

| | | | | |
|---|---|---|---|---|
| 6,428,358 | B1 | 8/2002 | Figueroa et al. | |
| 8,821,188 | B2 * | 9/2014 | Chang et al. | 439/607.01 |
| 8,932,080 | B2 * | 1/2015 | Chang et al. | 439/607.1 |
| 2009/0111325 | A1 * | 4/2009 | Ju | 439/607.55 |

* cited by examiner

*Primary Examiner* — Abdullah Riyami
*Assistant Examiner* — Harshad Patel
(74) *Attorney, Agent, or Firm* — Wei Te Chung; Ming Chieh Chang

(57) ABSTRACT

An electrical connector for electrically connecting a CPU with a PCB includes a frame, a plurality of base units assembled onto the frame and a plurality of contacts retained in the base units. The base units extend in a longitudinal direction and are assembled side by side in a transverse direction substantially perpendicular to the longitudinal direction. Each of the base units includes an insulating housing and a shielding member embedded within the insulating housing. The shielding member includes a first portion extending in the longitudinal direction and multiple second portions extending in a direction intersecting with the longitudinal direction, the second portions together with the first portion define multiple chambers. The contacts are located in the chambers defined by the shielding member.

20 Claims, 16 Drawing Sheets

ELECTRICAL CONNECTOR HAVING SHIELDING MEMBERS

BACKGROUND OF THE INVENTION

1. Field of the Invention

The present disclosure relates to an electrical connector, and more particularly to an electrical connector having shielding members for anti-EMI (Electro Magnetic Interference).

2. Description of the Related Art

Various electrical connectors are widely used in computer and other electronic devices. An electrical connector for electrically connecting a Central Processing Unit (CPU) to a Printed Circuit Board (PCB) typically comprises an insulating housing and a plurality of contacts retained therein. The contacts connect the CPU and the PCB so as to establish an electrical connection therebetween. However with increasing of the amount and speed of the data transmitted by the contacts, the arrangement density of the contacts increases and the EMI between the contacts becomes more and more serious. Therefore, an electrical connector with shielding plates around the contacts is provided. Referring to U.S. Pat. No. 6,428,358 issued to Figueroa, et al. on Aug. 6, 2002 discloses an electrical connector. The electrical connector comprises an insulating housing, a plurality of contacts retained in the insulating housing and a plurality of shielding plates intersected with each other and around the contacts. The shielding plates as a whole are embedded within the insulating housing. However, as the shielding plates intersect with each other, it is difficult for the plastic to flow in the injection molding process and the quality of the injection can not be ensured.

In view of the above, an improved electrical connector is desired to overcome the problems mentioned above.

SUMMARY OF THE INVENTION

Accordingly, an object of the present disclosure is to provide an electrical connector having a better shielding effect and easy to be manufactured.

In order to achieve the object set forth, an electrical connector with a plurality of shielding members is provided. The electrical connector comprises a frame defining a cavity, a plurality of base units assembled into the cavity of the frame and a plurality of contacts retained in the base units. The base units extend in a longitudinal direction and are assembled side by side in a transverse direction substantially perpendicular to the longitudinal direction. Each of the base units comprises an insulating housing and a shielding member embedded within the insulating housing. The shielding member comprises a first portion extending in the longitudinal direction and multiple second portions substantially parallel to each other and extending in a direction intersecting with the longitudinal direction, the second portions together with the first portion define multiple chambers. The contacts are located in the chambers defined by the shielding member.

DESCRIPTION OF PREFERRED EMBODIMENT

Reference will now be made to the drawings to describe the present disclosure in detail.

FIGS. 1 to 7 show a first embodiment of the present disclosure. The electrical connector 100 comprises a frame 1, a plurality of base units 2 assembled on the frame 1 and a plurality of contacts 5 retained in the base units 2.

Figure 1:
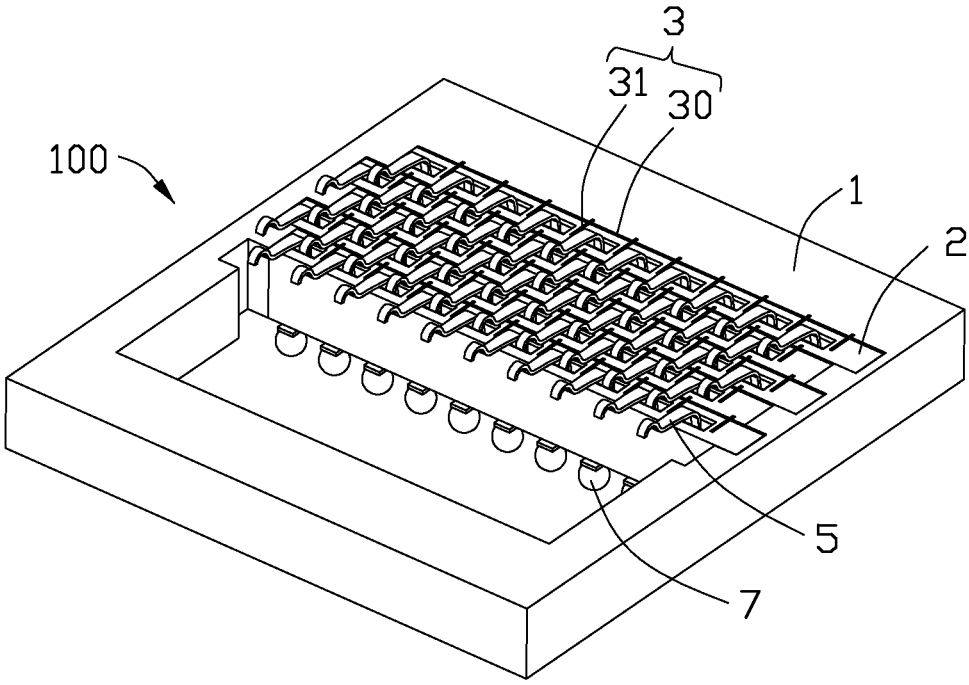
FIG. 1 is an assembled, perspective view of an electrical connector in accordance with a first embodiment of the present disclosure.
Figure 2:
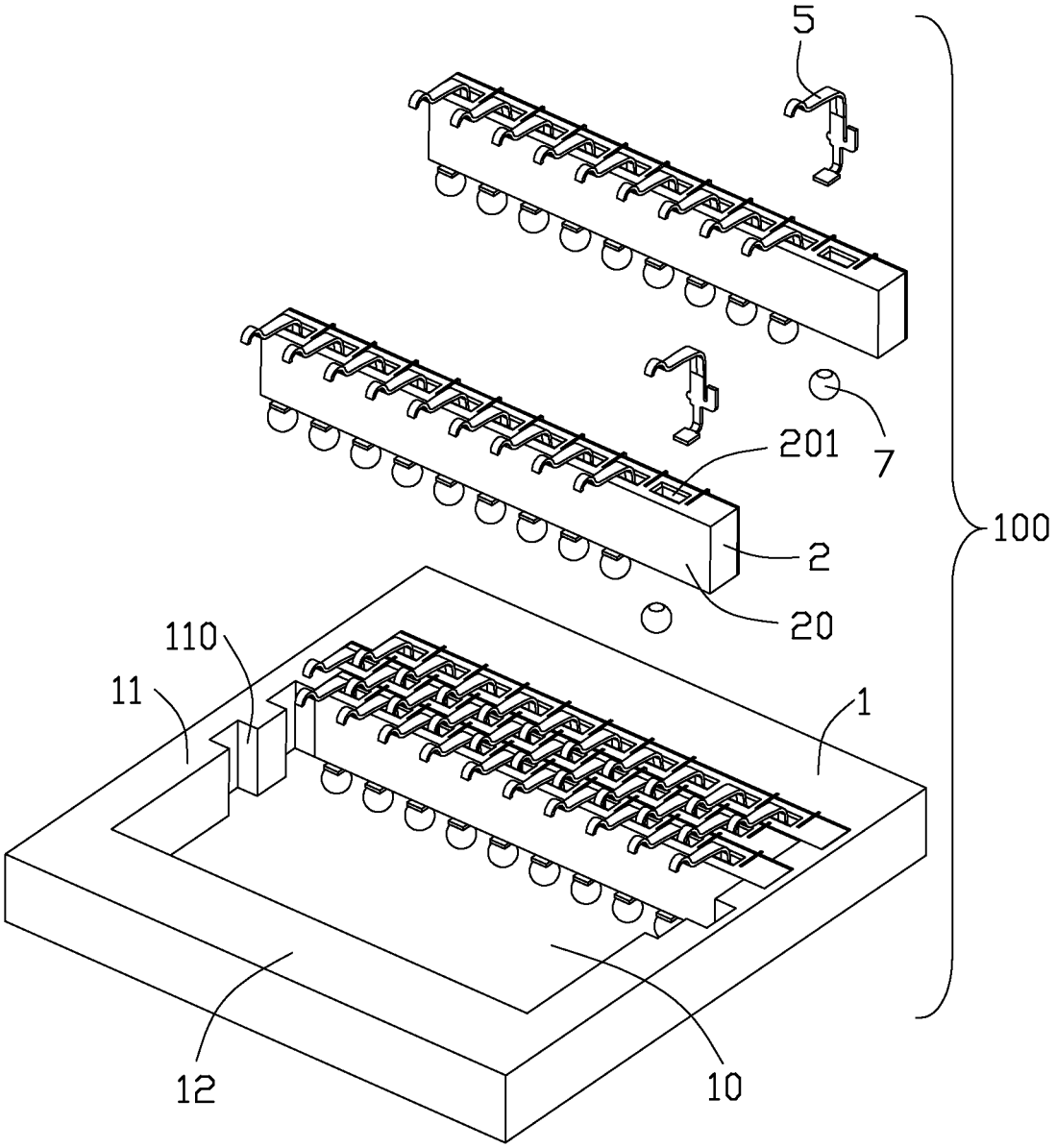
FIG. 2 is an exploded, perspective view of the electrical connector shown in FIG. 1.

Referring to FIG. 1 and FIG. 2, the frame 1 is rectangular comprising two ends 12 opposite to each other and two side walls 11 opposite to each other connecting said two ends 12. The side walls 11 together with two ends 12 define a cavity 10. A plurality of recesses 110 is defined on said two side walls 11 alternately for assembling the base units 2 into the cavity 10.

Figure 3:
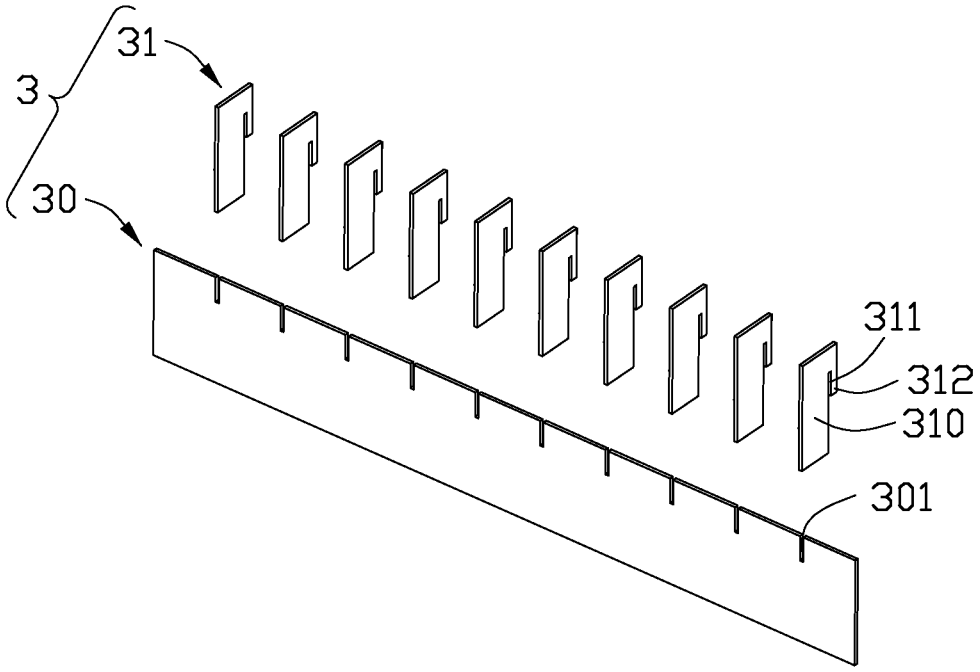
FIG. 3 is an exploded, perspective view of a shielding member shown in FIG. 1.
Figure 4:
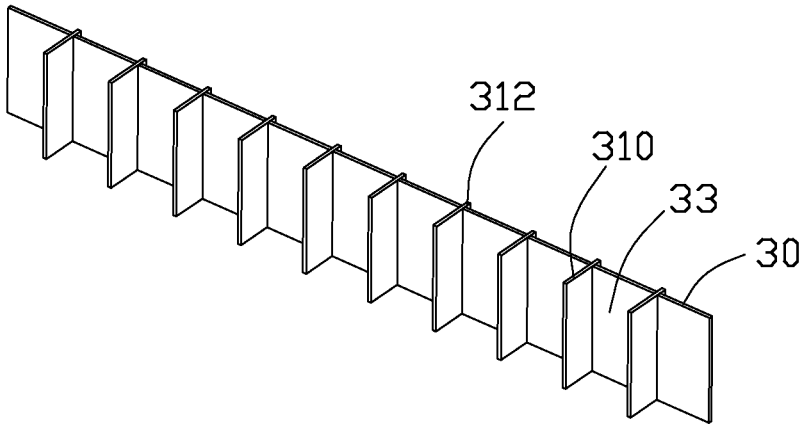
FIG. 4 is an assembled, perspective view of the shielding member shown in FIG. 3.
Figure 5:
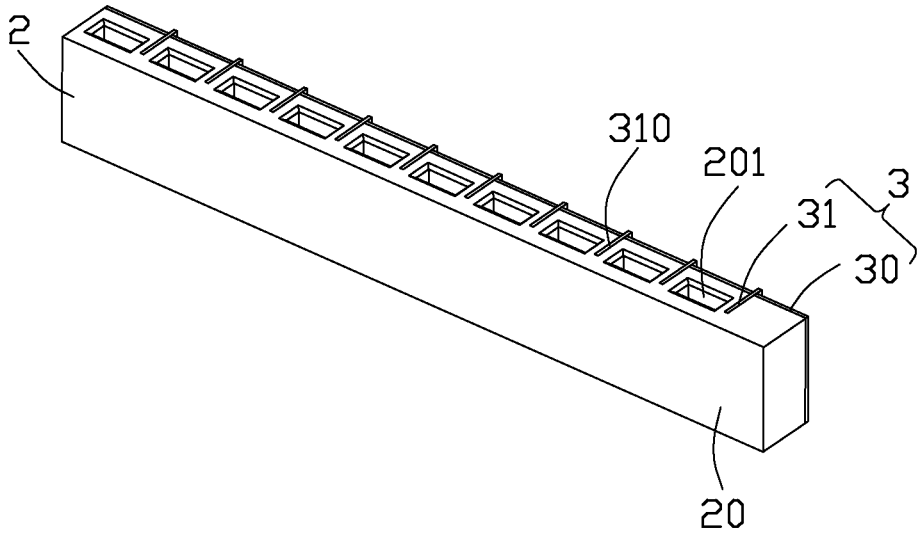
FIG. 5 is a perspective view of a base unit shown in FIG. 1.

Referring to FIG. 3 to FIG. 5, the base unit 2 extends in a longitudinal direction and comprises a row of receiving holes 201 extending in the longitudinal direction for receiving a row of contacts 5. The base unit 2 comprises an insulating housing 20 and a shielding member 3 embedded within the insulating housing 20. The shielding member 3 is made from metal plates comprising a first portion 30 extending in the longitudinal direction and multiple second portions 31 substantially parallel to each other assembled on the first portion 30. The first portion 30 comprises a plurality of first slots 301 arranged in a row for assembling the second portions 31. The second portion 31 comprises a body portion 310 and a retaining portion 312. A second slot 311 is defined between the body portion 310 and the retaining portion 312. When assembling, the second slot 311 matches with the first slot 301 while the body portion 310 and the retaining portion 312 locate on two sides of the first portion 30 to assemble thereon. The second portion 31 extends in a direction intersecting with the longitudinal direction. In this embodiment, the second portion 31 extends in a transverse direction perpendicular to the longitudinal direction. The body portions 310 of the second portions 31 are arranged in a row in the longitudinal direction. The body portions 310 together with the first portion 30 define a plurality of chambers 33. After injection molding process, the body portions 310 of the second portions 31 are insert molded into the insulating housing 20, the receiving holes 201 are formed in the chambers 33.

Referring to FIG. 5, the dimension of the insulating housing 20 in the transverse direction is defined as the thickness of the insulating housing 20. The dimension of the body portion 310 extending in the transverse direction is less than the thickness of the insulating housing 20.

Figure 6:
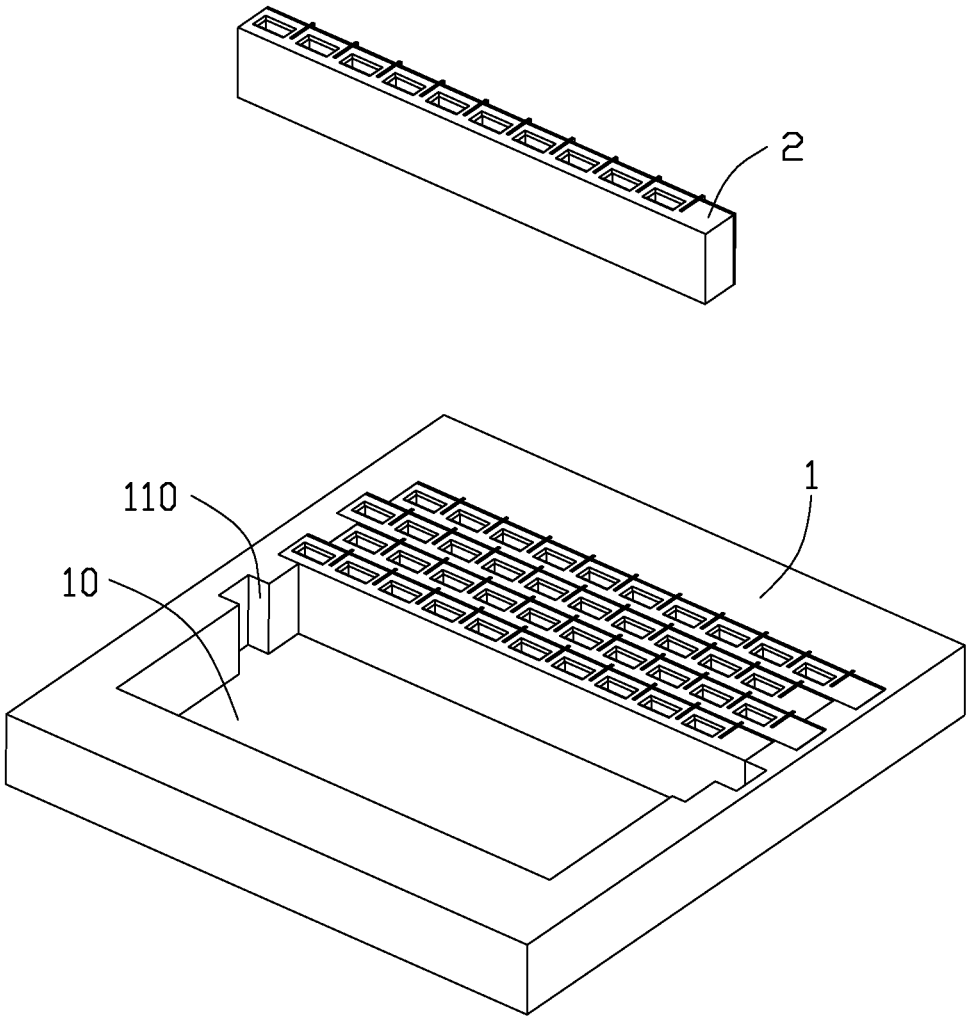
FIG. 6 is a perspective view of the electrical connector shown in FIG. 1, wherein the base unit is assembling in a frame.
Figure 7:
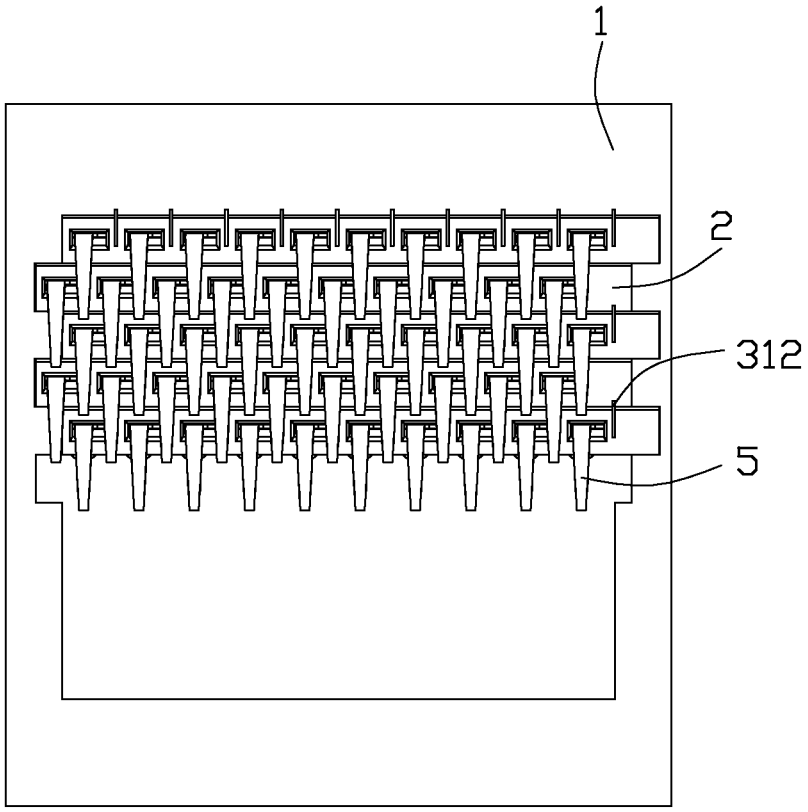
FIG. 7 is a top view of the electrical connector shown in FIG. 1.
Figure 8:
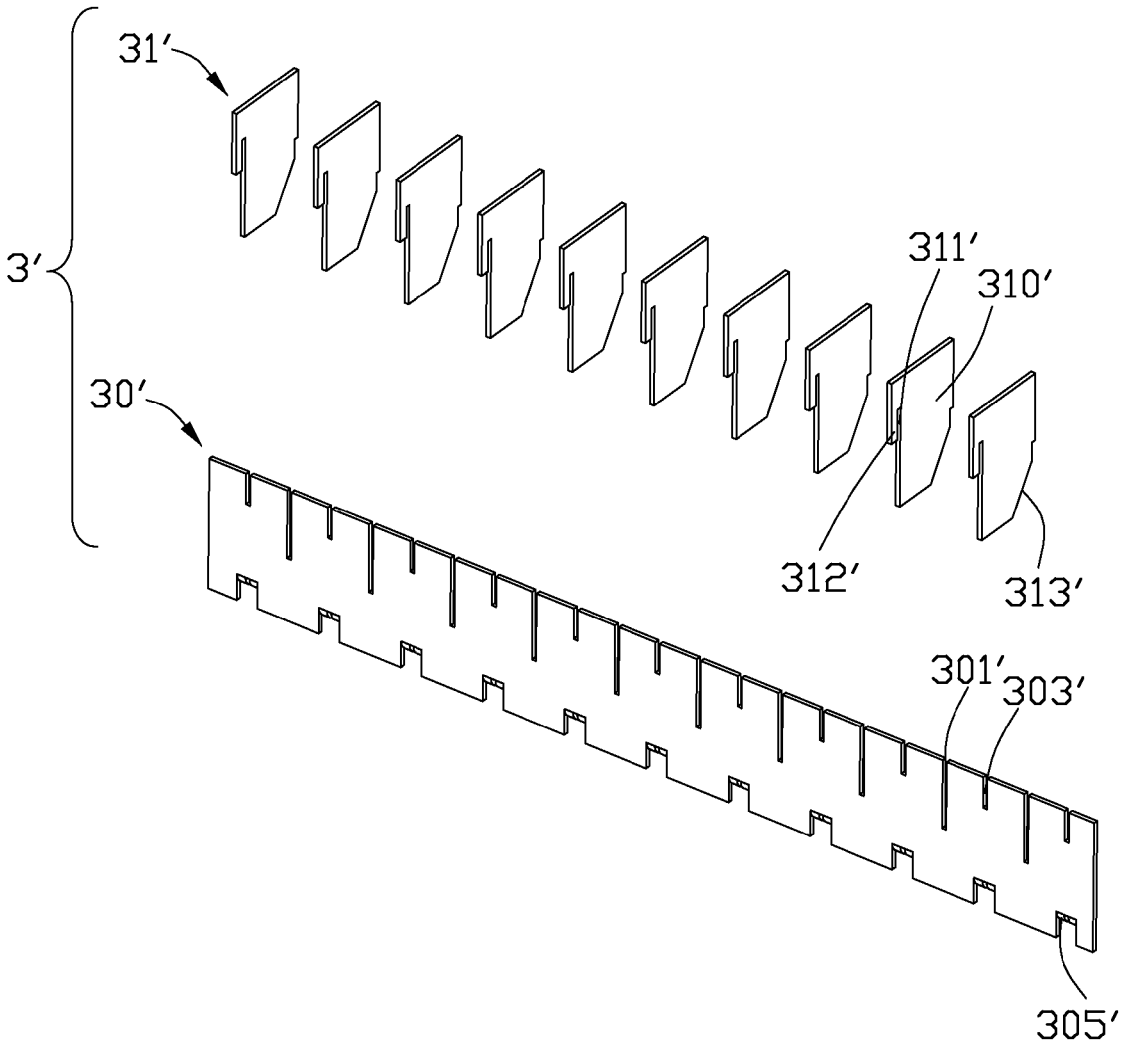
FIG. 8 is an exploded, perspective view of a shielding member in accordance with a second embodiment of the present disclosure.
Figure 9:
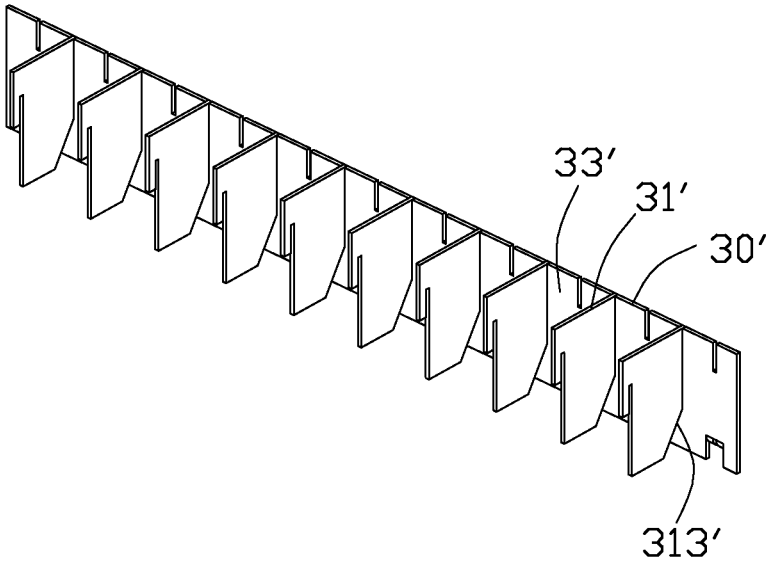
FIG. 9 is an assembled, perspective view of the shielding member shown in FIG. 8.
Figure 10:
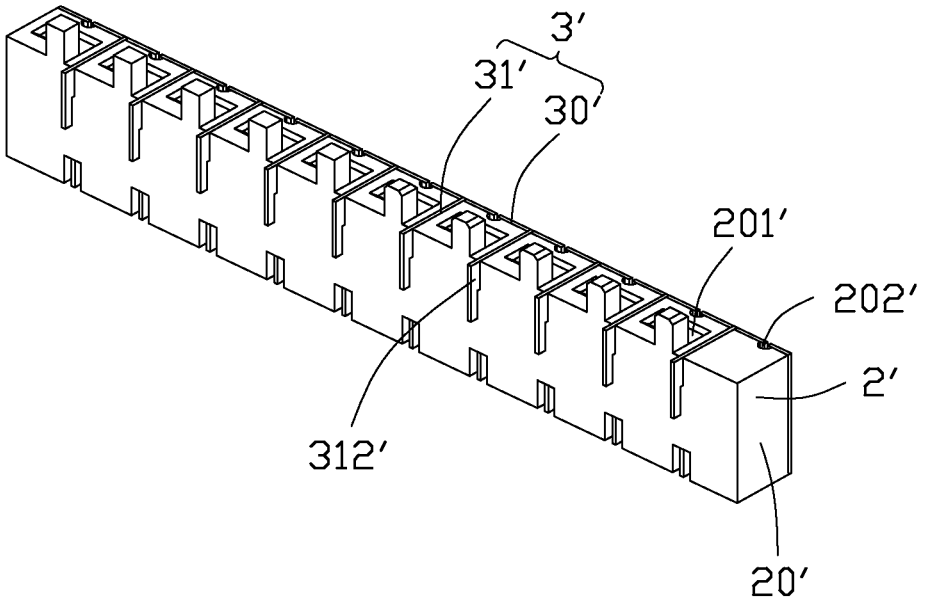
FIG. 10 is a perspective view of a base unit of the second embodiment of the present disclosure.
Figure 11:
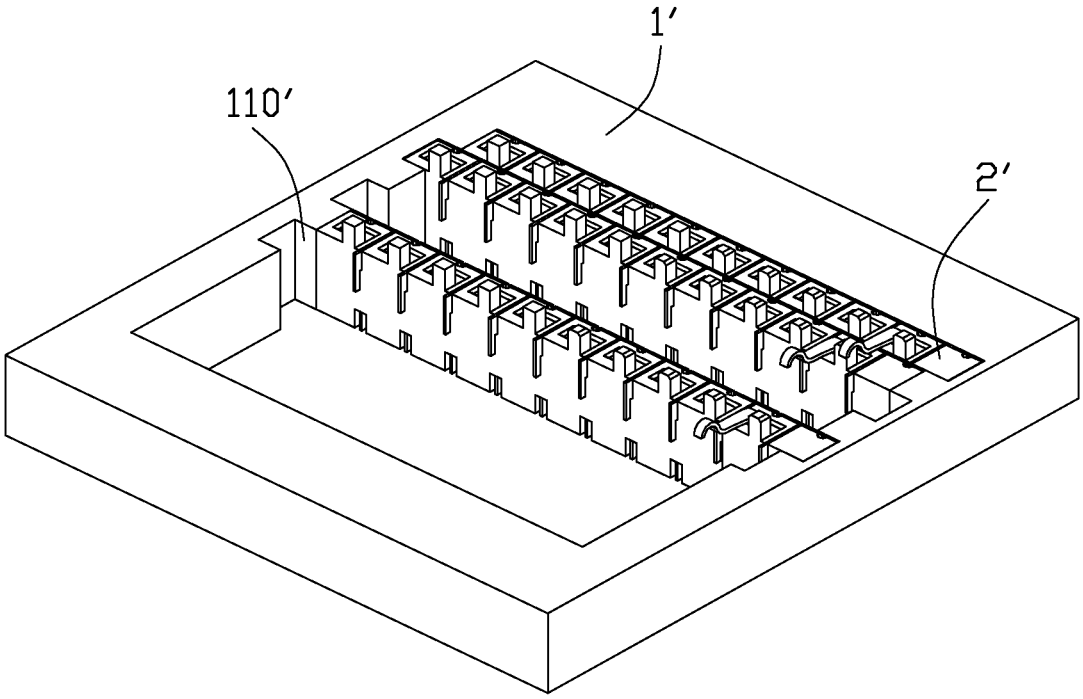
FIG. 11 is a perspective view of the electrical connector shown in FIG. 10, wherein the base unit is assembling in a frame.
Figure 12:
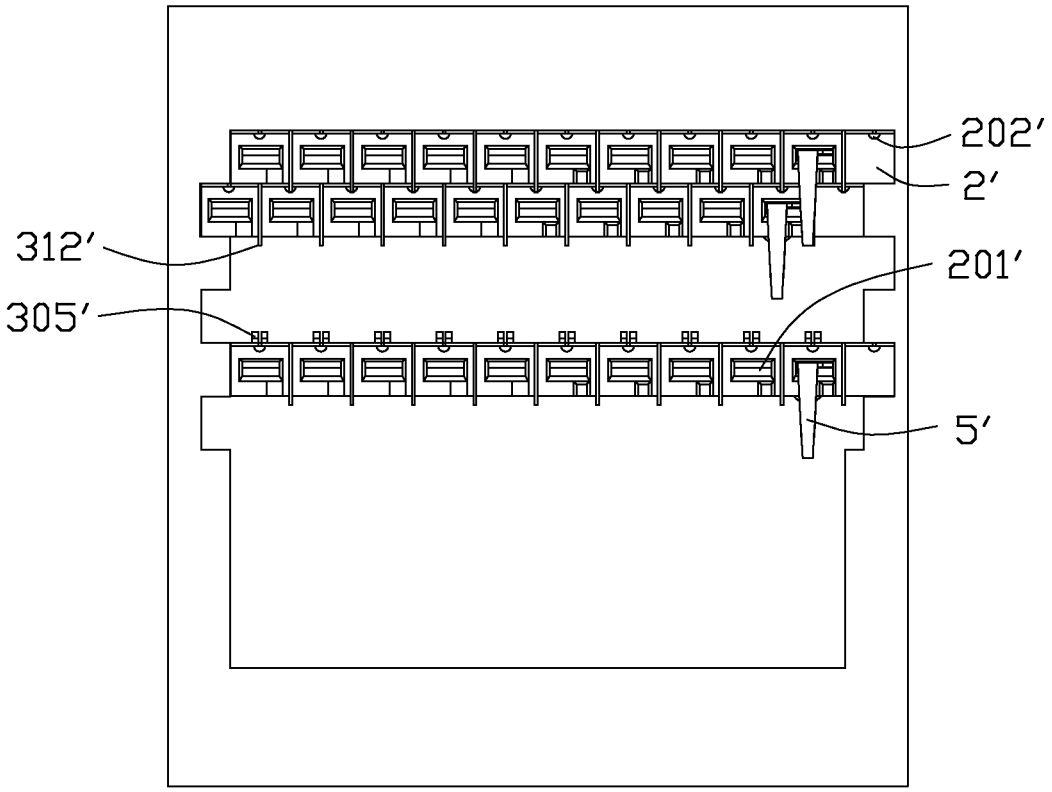
FIG. 12 is a top view of the electrical connector shown FIG. 11.
Figure 13:
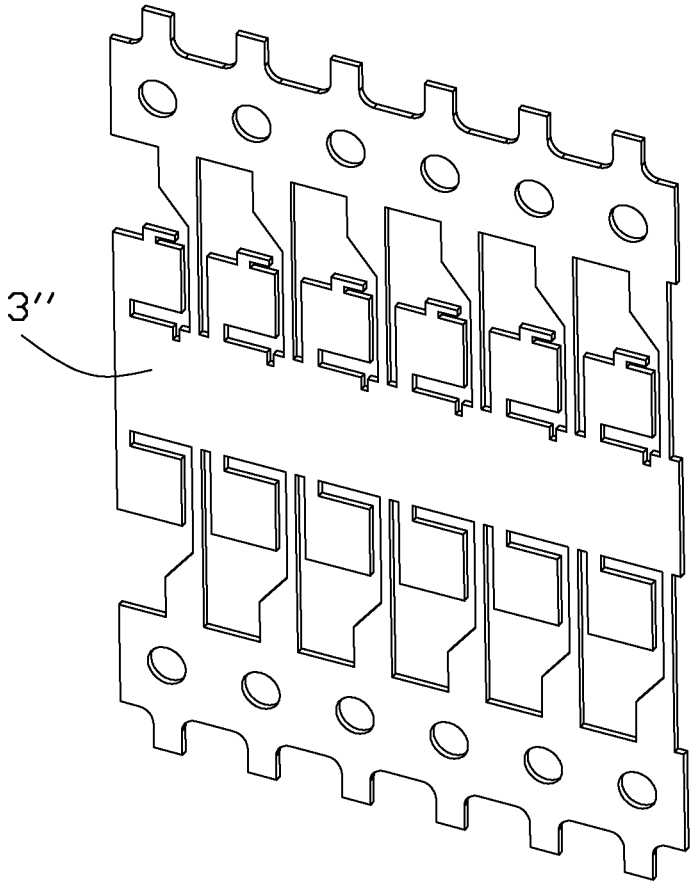
FIG. 13 is a perspective view of a shielding member in accordance with a third embodiment of the present disclosure, shown the shielding member stamped from a metal sheet.
Figure 14:
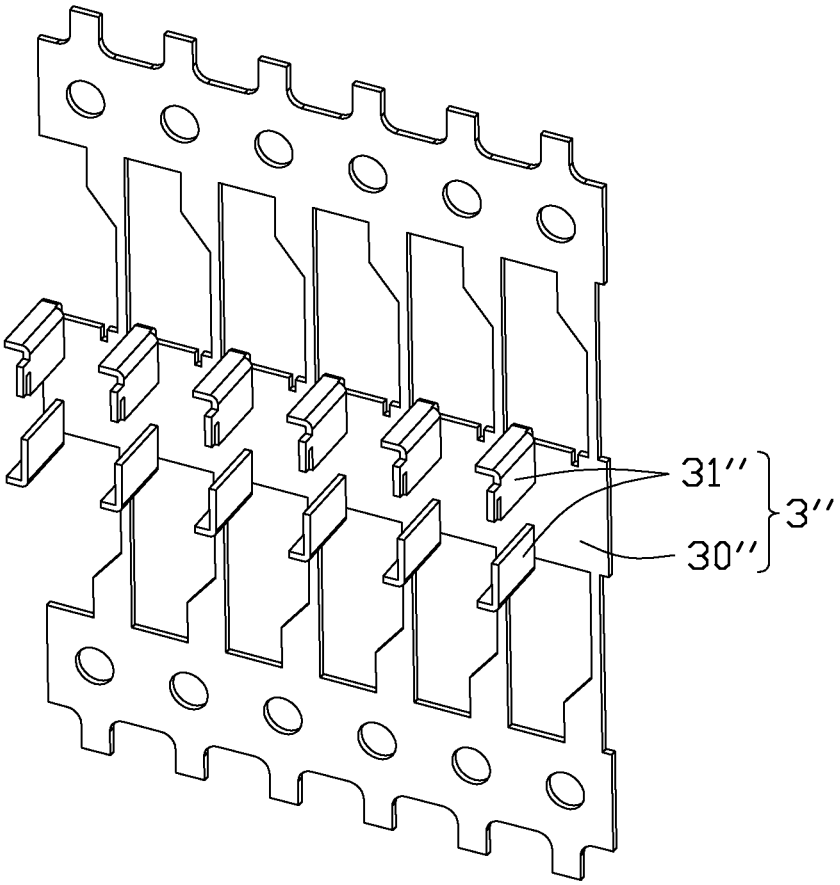
FIG. 14 is a perspective view of the shielding member shown in FIG. 13 wherein the shielding member is bent into predetermined shape after stamped.
Figure 15:
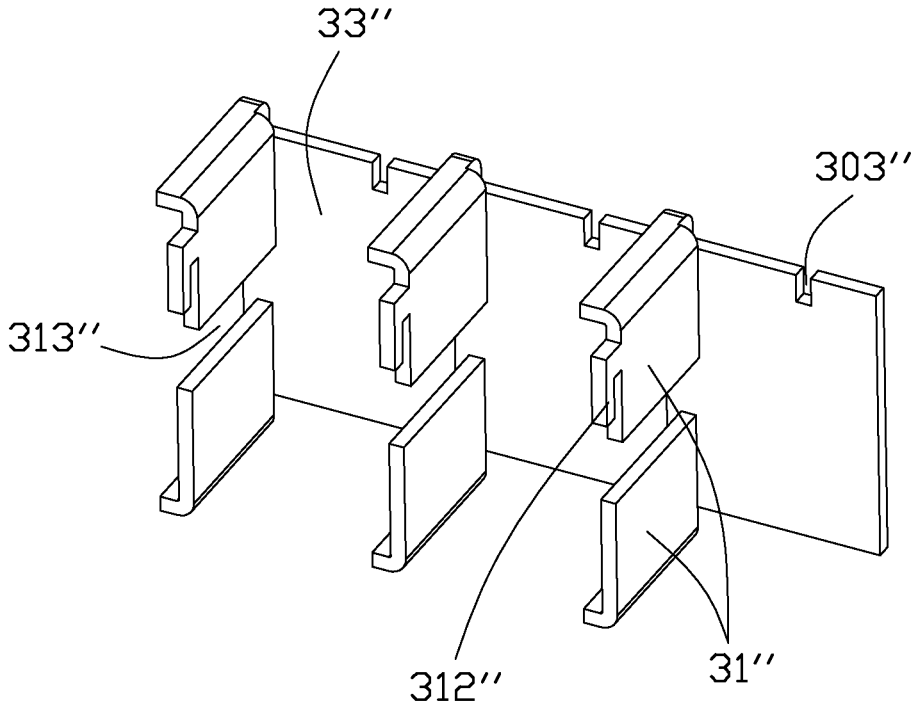
FIG. 15 is a perspective view of the shielding member shown in FIG. 13.
Figure 16:
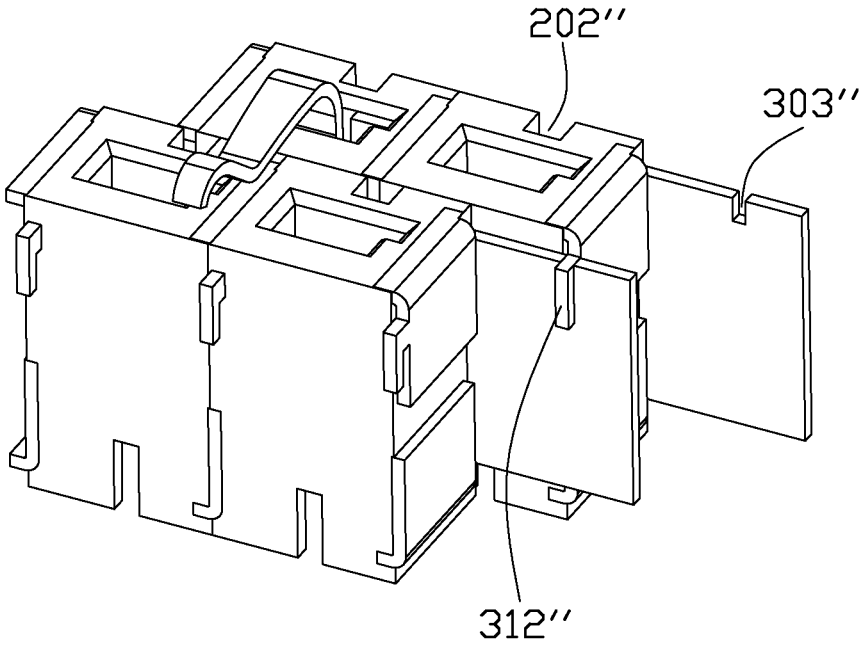
FIG. 16 is a schematic view of the electrical connector with the shielding member shown in FIG. 15.

Referring to FIG. 6 and FIG. 7, the manufacturing process of the electrical connector in accordance with the first embodiment of the present disclosure will now be described as follows. Firstly, the second portions 31 and the first portion 30 are assembled together to form the shielding member 3 defining a plurality of chambers 33. Secondly, the shielding member 3 is positioned in a mold and begin an injection molding process, the molten plastic flow into the chambers 33 and finally solidify forming the insulating housing 20 with a row of receiving holes 201 located in the chambers 33, the shielding member 3 is embedded within the insulating housing 20 forming the base unit 2. Thirdly, the base units 20 are assembled into the recesses 110 of the frame 1 side by side in the transverse direction, where the retaining portion 312 of the shielding member 3 engages the insulating housing 20 of the adjacent base unit 20. Finally, the contacts 5 are assembled into the receiving holes 201 with solder balls 7 for soldering on the PCB. The contact 5 comprises a retaining portion for retaining into the base unit 20. The width of the retaining portion is less than the width of the chamber 33 in the longitudinal direction for being shielded thereby. In this embodiment, the contacts 5 are assembled into the receiving holes 201, however, obviously, in other embodiment, the contacts 5 can also be embedded into the insulating housing and located in the chambers 33.

FIGS. 8 to 12 show a second embodiment of the present disclosure. The main difference between the second embodiment and the first embodiment is the structure of the shielding member. The shielding member 3' of the second embodiment comprises a first portion 30' extending in the longitudinal direction and multiple second portions 31' substantially parallel to each other assembled on the first portion 30'. The first portion 30' comprises a plurality of first slots 301' and a plurality of third slots 303' arranged in a row and spaced from each other. The first portion 30' further comprises a plurality of tails 305' bent from a lower edge of the first portion 30'. The second portion 31' comprises a body portion 310' and a retaining portion 312'. A second slot 311' is defined between the body portion 310' and the retaining portion 312'. When assembling, the body portion 310' of the second portion 31' matches with the first slot 301' of the first portion 30' to assemble thereon. The second portion 31' extends in the transverse direction perpendicular to the longitudinal direction. The body portions 310' of the second portions 31' are arranged in a row in the longitudinal direction. The body portions 310' together with the first portion 30' define a plurality of chambers 33'. The insulating housing 20' comprises a plurality of retaining slots 202' corresponding to the third slots 303' for engaging with the retaining portions 312' of the adjacent base unit 2'. The second portion 31' further comprises a cutout 313' formed on a lower corner of the body portion 310'. A plurality of cutouts 313' is arranged in a row in the longitudinal direction forming a passageway communicating a plurality of chambers 33'. In injection molding process, the molten plastic flows through the passageway formed by the cutouts 313' into the chambers 33' and finally solidifies into the insulating housing 20' with a row of receiving holes 201' therethrough.

FIGS. 13 to 16 show a third embodiment of the present disclosure. The main difference between the third embodiment and the first embodiment is that the shielding member 3" of the third embodiment is stamped and bent from a whole metal sheet. The shielding member 3" comprises a first portion 30" extending in a longitudinal direction and a plurality of second portions 31" bent from opposite upper and lower ends of the first portion 30" and substantially perpendicular to the first portion 30". The second portion 31" comprises a cutout 313". A plurality of cutout 313" is arranged in the longitudinal direction forming a passageway communicating a plurality of chambers 33". The first portion 30" comprises a plurality of third slots 303", the second portion 31" comprises a retaining portion 312". The insulating housing comprises a plurality of retaining slots 202" corresponding to the third slots 303" for engaging with the retaining portions 312" of the adjacent base unit. The shielding member is stamped and bent from a metal sheet, which is easy to be manufactured and the tolerance can be well controlled.

Anyhow, according to the above described embodiments, an electrical connector with shielding members is provided. The shielding member extends in two directions intersecting with each other and embedded within a base unit, thus, the electrical connector having a better shielding effect and easy to be manufactured.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for electrically connecting a central processing unit to a printed circuit board, comprising:

a frame defining a cavity;

a plurality of base units assembled into the cavity of the frame, the base units extending in a longitudinal direction and arranged side by side in a transverse direction substantially perpendicular to the longitudinal direction, each of the base units comprising an insulating housing and a shielding member embedded within the insulating housing, the shielding member comprising a first portion extending in the longitudinal direction and multiple second portions substantially parallel to each other and extending in a direction intersecting with the longitudinal direction, the second portions together with the first portion defining multiple chambers; and a plurality of contacts retained in the base units and located in the chambers defined by the shielding member.

2. The electrical connector as claimed in claim 1, wherein each base unit retains one row of contacts, the contacts retained in a corresponding base unit are offset from the contacts retained in the adjacent base unit.

3. The electrical connector as claimed in claim 2, wherein the frame comprises two ends opposite to each other and two side walls opposite to each other connecting said two ends, and wherein said two side walls alternately comprises a plurality of recesses facing towards the cavity for receiving the base units.

4. The electrical connector as claimed in claim 1, wherein the second portion of the shielding member extends in the transverse direction perpendicular to the longitudinal direction.

5. The electrical connector as claimed in claim 1, wherein the second portion is assembled onto the first portion.

6. The electrical connector as claimed in claim 5, wherein the first portion comprises a plurality of first slots substantially parallel to each other in the longitudinal direction, the second portion matches with the first slots to assemble thereon.

7. The electrical connector as claimed in claim 1, wherein the second portion is bent from the first portion integrally.

8. The electrical connector as claimed in claim 1, wherein the second portion comprises a retaining portion, the retaining portion engages with the insulating housing of the adjacent base unit.

9. The electrical connector as claimed in claim 8, wherein the first portion comprises a plurality of third slots corresponding to the retaining portions of the adjacent base unit for matching with each other.

10. The electrical connector as claimed in claim 1, wherein each of the second portions comprises a cutout, multiple cutouts are arranged in a row forming a passageway communicating the multiple chambers.

11. An electrical connector for connecting an electronic component, comprising:

a plurality of base units discrete from each other and assembled together to form an area for supporting the electronic component, each of the base units comprising an insulating housing and a shielding member embedded within the insulating housing, the shielding member comprising a first portion and a plurality of second portions coupled to the first portion to form a plurality of chambers, the shielding member of a corresponding base unit disengages from the shielding member of other base units before the base units being assembled together; and at least one contact comprising a retaining portion retained in the base unit, a width of the retaining portion is less than the distance of two adjacent second portions.

12. The electrical connector as claimed in claim 11, wherein the second portion of the shielding member in a corresponding base unit is offset from the second portion of another shielding member in the adjacent base unit.

13. The electrical connector as claimed in claim 11, wherein the second portion comprises a retaining portion, the retaining portion engages with the insulating housing of the adjacent base unit after the base units are assembled together.

14. The electrical connector as claimed in claim 11, wherein a plurality of second portions comprises a plurality of cutouts arranged in a row forming a passageway communicating the multiple chambers.

15. An electrical connector assembly comprising:

at least one unit including:

a metallic shielding member defined by at least a first portion extending in a longitudinal direction and a plurality of second portions extending in a transverse direction perpendicular to said longitudinal direction in a securely intersectional manner so as to form a plurality of corresponding chambers communicating with an exterior in a vertical direction perpendicular to both said longitudinal direction and said transverse direction; and an insulative housing associatively coated, via an insert molding process, upon said shielding member so as to hide said shielding member horizontally; wherein said housing forms plurality of passageways in the corresponding chambers, respectively, and a plurality of contacts disposed in the corresponding passageways, respectively; wherein each of said contacts defines an upper contacting section upwardly obliquely extending above a top face of the housing.

16. The electrical connector assembly as claimed in claim 15, wherein there are a plurality shielding members stacked with one another along the transverse direction with the associated housings and contacts so as to form a matrix type arrangement wholly.

17. The electrical connector assembly as claimed in claim 16, wherein the chambers are essentially completely surrounded by the shielding member.

18. The electrical connector assembly as claimed in claim 16, wherein the chambers are offset from those in a neighboring shielding member in the transverse direction.

19. The electrical connector assembly as claimed in claim 16, wherein the second portions are unitarily formed with the first portion.

20. The electrical connector assembly as claimed in claim 16, further including a frame defining a cavity in which said plurality of shielding members with the associated housings and contacts are embedded.

* * * * *